US010274874B2

(12) United States Patent
Sasaki et al.

(10) Patent No.: US 10,274,874 B2
(45) Date of Patent: Apr. 30, 2019

(54) INTERMEDIATE TRANSFER MEMBER, METHOD FOR PRODUCING INTERMEDIATE TRANSFER MEMBER, AND IMAGE FORMING APPARATUS

(71) Applicant: Konica Minolta, Inc., Tokyo (JP)

(72) Inventors: Teruo Sasaki, Tokyo (JP); Akihiro Honya, Tokyo (JP); Shinichi Hamaguchi, Tokyo (JP); Shinichi Yabuki, Kanagawa (JP); Junji Kanda, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/812,316

(22) Filed: Nov. 14, 2017

(65) Prior Publication Data

US 2018/0136590 A1 May 17, 2018

(30) Foreign Application Priority Data

Nov. 16, 2016 (JP) ..... 2016-223296

(51) Int. Cl.
*G03G 15/16* (2006.01)

(52) U.S. Cl.
CPC ..... *G03G 15/162* (2013.01); *G03G 15/161* (2013.01); *G03G 15/1685* (2013.01)

(58) Field of Classification Search
None
See application file for complete search history.

(56) References Cited

U.S. PATENT DOCUMENTS

| | | | | |
|---|---|---|---|---|
| 2,380,420 | A * | 7/1945 | Emerson | C07C 215/76 564/387 |
| 4,970,341 | A * | 11/1990 | Summerford | C07C 291/04 546/184 |
| 6,978,111 | B2 * | 12/2005 | Nagata | G03G 15/161 399/348 |
| 2012/0301190 | A1 * | 11/2012 | Tanaka | G03G 15/0189 399/297 |
| 2015/0220026 | A1 | 8/2015 | Honya et al. | |

FOREIGN PATENT DOCUMENTS

| | | | |
|---|---|---|---|
| EP | 0859292 | A2 | 8/1998 |
| JP | 2013024898 | A | 2/2013 |
| JP | 2014006327 | A | 1/2014 |
| JP | 2015125187 | A | 7/2015 |
| WO | 2013/151132 | A1 | 10/2013 |

OTHER PUBLICATIONS

Extended European Search Report dated Apr. 6, 2018 from corresponding European Application No. 17201735.2.

* cited by examiner

*Primary Examiner* — Victor Verbitsky
(74) *Attorney, Agent, or Firm* — Lucas & Mercanti, LLP

(57) ABSTRACT

An intermediate transfer member includes a resin substrate layer and a surface layer disposed on the substrate layer. The surface layer is a cured product of a resin composition containing a polyfunctional (meth)acrylate, a photopolymerization initiator, and a tertiary amine compound having a melting point of 30° C. or more. In the tertiary amine compound, at least one hydrogen atom is bonded to one carbon atom out of three carbon atoms bonded to a nitrogen atom.

10 Claims, 2 Drawing Sheets

INTERMEDIATE TRANSFER MEMBER, METHOD FOR PRODUCING INTERMEDIATE TRANSFER MEMBER, AND IMAGE FORMING APPARATUS

CROSS REFERENCE TO RELATED APPLICATIONS

The entire disclosure of Japanese Patent Application No. 2016-223296 filed on Nov. 16, 2016, is incorporated herein by reference in its entirety.

BACKGROUND

Technological Field

The present invention relates to an intermediate transfer member, a method for producing an intermediate transfer member, and an image forming apparatus.

Description of Related Art

It is conventionally known that an intermediate transfer member including a surface layer formed from an acrylic resin by using a photopolymerization initiator has high durability (see, for example, Japanese Patent Application Laid-Open No. 2013-024898).

Besides, an intermediate transfer member whose dynamic friction force is reduced by using a lubricant mixedly in a surface layer is also known (see, for example, Japanese Patent Application Laid-Open No. 2015-125187). In the intermediate transfer member described in Japanese Patent Application Laid-Open No. 2015-125187, even if the surface is abraded in use, the dynamic friction force can be reduced over a long period of time because the lubricant is disposed in the surface.

Furthermore, as a curing accelerator for a surface layer of an intermediate transfer member, triethylamine, triethanolamine and the like have been disclosed (see, for example, Japanese Patent Application Laid-Open No. 2014-006327).

Since an intermediate transfer member is used with its shape freely deformed as needed, a surface layer is set to have deformation freedom in structure on the molecular level. Therefore, a low molecular weight component is capable of moving in the surface layer in the intermediate transfer member. Accordingly, bleed-out of low molecular components such as an unreacted residual monomer and an insufficiently reacted residual oligomer easily occurs over time, and hence, the dynamic friction force also increases over time.

In general, if a surface layer is formed from a resin to be polymerized through irradiation with actinic radiation such as ultraviolet rays, the polymerization reaction occurring in the vicinity of the surface tends to be inhibited by oxygen. As a countermeasure against this problem, the inhibition by oxygen can be suppressed by replacing the reaction environment by nitrogen. It is difficult, however, to completely replace the reaction environment by nitrogen. Therefore, production of low molecular weight components cannot be completely suppressed, and hence, the bleed-out of a low molecular weight component occurs over time to increase the dynamic friction force in some cases.

In an intermediate transfer member described in Japanese Patent Application Laid-Open No. 2013-024898, if a reaction rate of the acrylic resin is low, the bleed-out of an unreacted residual monomer or an insufficiently reacted residual oligomer occurs, and hence the dynamic friction force increases over time in some cases. The increase in the dynamic friction force is significant in a high humidity/high temperature environment (HH environment), which is probably because the bleed-out is accelerated since the viscosity of a low molecular weight component is lowered due to a high temperature and hence the mobility is increased. Besides, it is presumed that the dynamic friction force is increased because a bled out component unavoidably absorbs moisture due to a high humidity, and hence, the amount of such a component to be cleaned is increased.

Besides, an amine described in Japanese Patent Application Laid-Open No. 2014-006327 melts at a practical temperature and dissolves a low molecular weight component therein, and hence can accelerate the bleed-out. As a result, the amine described in Japanese Patent Application Laid-Open No. 2014-006327 can accelerate a polymerization reaction but has an insufficient effect of suppressing the increase in the dynamic friction force.

As described so far, there still remains room for making consideration of suppressing the increase in the dynamic friction force over time in the conventional intermediate transfer members.

A first object of the present invention is to provide an intermediate transfer member capable of suppressing an increase in dynamic friction force over time. Besides, a second object of the present invention is to provide an image forming apparatus in which a defect is avoided by suppressing increase of dynamic friction force.

SUMMARY

To achieve the first object, an aspect of the present invention provides an intermediate transfer member including a resin substrate layer and a surface layer disposed on the substrate layer, in which the surface layer contains a cured product of a resin composition containing a polyfunctional (meth)acrylate, a photopolymerization initiator, and a tertiary amine compound having a melting point of 30° C. or more, and at least one hydrogen atom is bonded to one carbon atom out of three carbon atoms bonded to a nitrogen atom in the tertiary amine compound.

To achieve the first object, another aspect of the present invention provides a method for producing an intermediate transfer member including a resin substrate layer and a surface layer disposed on the substrate layer, including the steps of: forming, on the substrate layer, a coating film containing a resin composition that contains a polyfunctional (meth)acrylate, a photopolymerization initiator, and a tertiary amine compound having a melting point of 30° C. or more; and forming the surface layer on the substrate layer by causing radical polymerization of the polyfunctional (meth) acrylate contained in the coating film, in which a tertiary amine compound in which at least one hydrogen atom is bonded to one carbon atom out of three carbon atoms bonded to a nitrogen atom is used as the tertiary amine compound.

To achieve the second object, an aspect of the present invention provides an electrophotographic image forming apparatus including: an intermediate transfer member that bears a toner image having been born on a photoconductor to transfer the toner image onto a recording medium; and a cleaner that removes an adhering substance adhering to a surface of the intermediate transfer member, in which the intermediate transfer member is the intermediate transfer member, and the cleaner includes an elastic member to be brought into contact with the surface of the intermediate transfer member to remove the adhering substance.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

An embodiment of the present invention will now be described in detail with reference to the accompanying drawings.

(Structure of Intermediate Transfer Member)

Figure 1A:
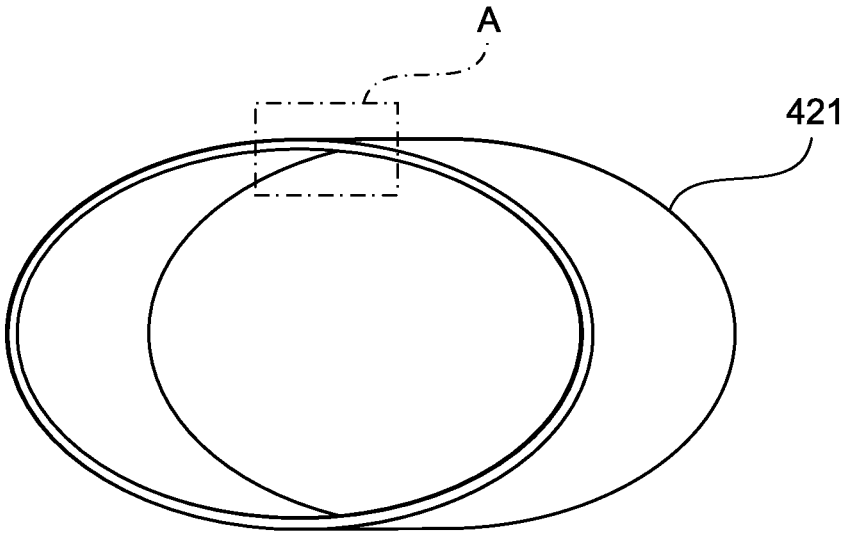
FIGS. 1A and 1B are diagrams illustrating a structure of an intermediate transfer member according to one embodiment of the present invention.
Figure 1B:
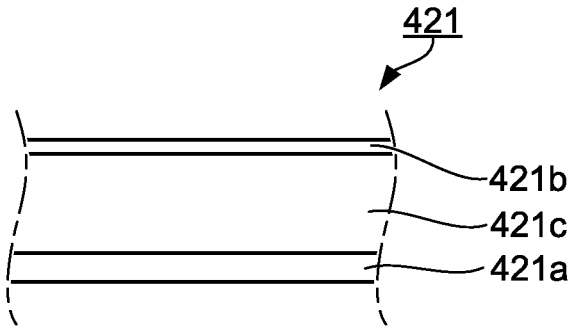

FIGS. 1A and 1B are diagrams illustrating the structure of intermediate transfer member 421. FIG. 1A is a perspective view of intermediate transfer member 421, and FIG. 1B is a partially enlarged cross-sectional view of region A surrounded by an alternate long and short dash line in FIG. 1A.

Intermediate transfer member 421 is incorporated in an image forming apparatus, so that a toner image having been primarily transferred onto an electrostatic latent image carrier (a photoconductor) can be secondarily transferred onto a recording medium.

As illustrated in FIGS. 1A and 1B, intermediate transfer member 421 includes substrate layer 421*a* and surface layer 421*b*. Besides, substrate layer 421*a* is positioned on an inner side of intermediate transfer member 421, and surface layer 421*b* is positioned on an outer side thereof. It is noted that elastic layer 421*c* made of an elastic body may be disposed between substrate layer 421*a* and surface layer 421*b*. Elastic layer 421*c* may have any of known structures. Intermediate transfer member 421 is an endless belt. Here, the term "endless" means, for example, a seamless loop shape.

Substrate layer 421*a* is made of a resin, and the resin can be appropriately selected from resins that do not denature or deform in a temperature range where intermediate transfer member 421 is used. Examples of the resins to be used include polycarbonate, polyphenylene sulfide, polyvinylidene fluoride, polyimide, polyamide imide, polyalkylene terephthalate (such as polyethylene terephthalate and polybutylene terephthalate), polyether, polyether ketone, polyether ether ketone, an ethylene tetrafluoroethylene copolymer and polyamide. From the viewpoint of heat resistance and strength, the resin preferably contains polyimide, polycarbonate, polyphenylene sulfide or polyalkylene terephthalate, and more preferably contains polyphenylene sulfide or polyimide. Polyimide can be obtained by heating polyamic acid, that is, a precursor of polyimide. Besides, polyamic acid can be obtained by dissolving, in an organic polar solvent, a substantially equimolar mixture of tetracarboxylic dianhydride or a derivative thereof and diamine for causing a reaction in a solution state. Incidentally, if a polyimide-based resin is used for substrate layer 421*a*, a content of the polyimide-based resin in substrate layer 421*a* is preferably 51% or more.

The thickness of substrate layer 421*a* is preferably 50 to 200 μm. Besides, substrate layer 421*a* may contain any of various known additives as long as it has the above-described function. An example of the additives includes a dispersant such as a nylon compound.

Surface layer 421*b* is a cured product of a resin composition containing a polyfunctional (meth)acrylate, a photopolymerization initiator and a tertiary amine compound having a melting point of 30° C. or more. Here, the term "polyfunctional (meth)acrylate" means a polyfunctional acrylate or a polyfunctional methacrylate.

The polyfunctional (meth)acrylate is a material for increasing the durability of intermediate transfer member 421. The polyfunctional (meth)acrylate is converted, through a polymerization reaction, into an acrylic cured product having a crosslinked structure. The valence of the polyfunctional (meth)acrylate is preferably 4 or more, and more preferably 5 to 6 so that a three-dimensional crosslinked structure decreases and that the strength of surface layer 421*b* is lowered.

Examples of the polyfunctional (meth)acrylate include the following compounds P-1 to P-6. It is noted that n in the compound P-3 represents a positive integer.

[Formula 1]

P-1

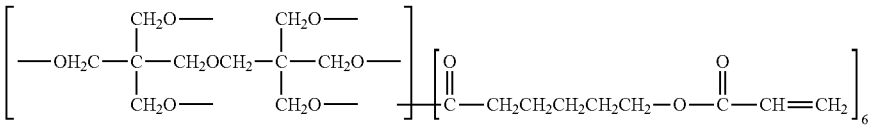

P-2

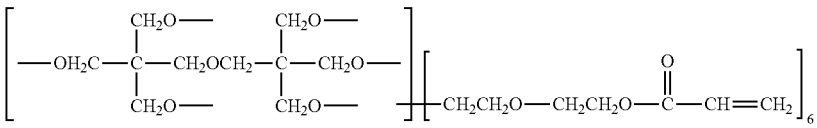

P-3

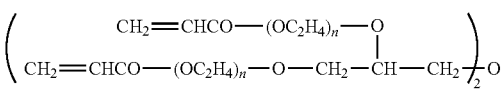

-continued

P-4

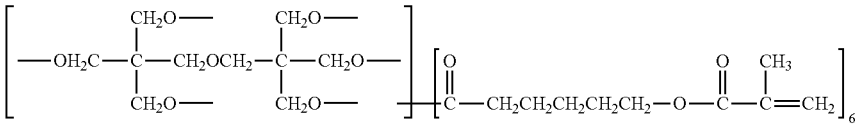

P-5

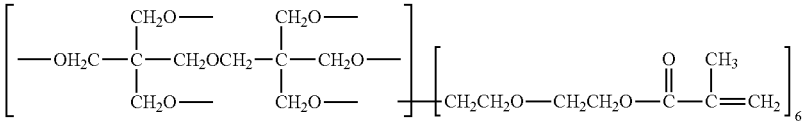

P-6

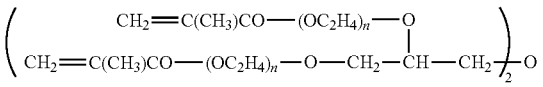

A content of the polyfunctional (meth)acrylate can be appropriately determined as long as an effect of the polyfunctional (meth)acrylate can be attained. The content of the polyfunctional (meth)acrylate in a monomer to be used is preferably 20 mass % or more, more preferably 40 mass % or more, and particularly preferably 60 mass % or more.

The photopolymerization initiator starts radical polymerization of the polyfunctional (meth)acrylate. As the photopolymerization initiator, an arbitrary photopolymerization initiator can be used. From the viewpoint of effectively starting the radical polymerization, the photopolymerization initiator is preferably a compound having a phosphine oxide skeleton or a compound having an oxime ester skeleton. An example of a photopolymerization initiator having a phosphine oxide skeleton includes Irgacure (R) 819, that is, a commercially available acyl phosphine oxide-based photopolymerization initiator containing bis-(2,4,6-trimethoxybenzoyl)-phenylphosphine oxide. Examples of a photopolymerization initiator having an oxime ester skeleton include Irgacure (R) OXE01 (manufactured by BASF), that is, a commercially available oxime ester-based photopolymerization initiator containing 1,2-octanedione,1-[4-(phenylthio) phenyl-,2-(o-benzoyloxime)] and Irgacure (R) OXE02 (manufactured by BASF), that is, a commercially available oxime ester-based photopolymerization initiator containing ethanone 1-[9-ethyl-6-(2-methylbenzoyl)-9H-carbazol-3-yl]-1,1-(o-acetyloxime). One of these photopolymerization initiators may be singly used, or two or more of these may be used together. A content of the photopolymerization initiator is preferably 0.1 to 20 parts by mass, and more preferably 0.5 to 10 parts by mass with respect 100 parts by mass of the polyfunctional (meth)acrylate.

The tertiary amine compound reduces inhibition of a radical polymerization reaction by oxygen. The tertiary amine compound is a compound in which at least one hydrogen atom is bonded to one carbon atom out of three carbon atoms bonded to a nitrogen atom. The tertiary amine compound has a representative structure as represented by the following formula (1):

[Formula 2]

formula (1)

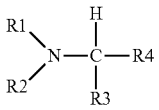

Each of R1 and R2 in formula (1) represents an alkyl group, an allyl group, or an aryl group. Besides, each of R3 and R4 in formula (1) represents a hydrogen atom, an alkyl group, an ally group, or an aryl group. R3 and R4 may be the same as or different from each other. R1 to R4 may be independent of one another, or any one of R1 to R4 may be bonded to another. Here, the term "bonded" means that a cyclic structure is formed with ends of substituents bonded to each other.

Besides, the tertiary amine compound is preferably a compound in which at least one aromatic group is bonded to the nitrogen atom. Such a tertiary amine compound has a representative structure, for example, as represented by the following formula (2):

[Formula 3]

formula (2)

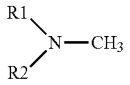

Each of R1 and R2 in formula (2) represents an alkyl group, an allyl group, or an aryl group. However, one of R1 and R2 represents an aryl group.

The tertiary amine compound used in the present invention has a melting point of 30° C. or more. In the present embodiment, the melting point of the tertiary amine compound is 30° C. or more, and is preferably higher as long as solubility in the resin composition, and compatibility with and dispersibility in the monomer immediately before polymerization can be attained. The melting point of the tertiary amine compound may be 30° C. or more, preferably 40° C. or more, more preferably 45° C. or more, further preferably 65° C. or more, and particularly preferably 95° C. or more so that it does not accelerate bleed-out by melting at a practical temperature.

Besides, from the viewpoint that reduction of the solubility is prevented and that a solvent is easily selected, the melting point of the tertiary amine compound is preferably less than 300° C., more preferably less than 250° C., and further preferably less than 200° C.

Here, "45° C." is the maximum temperature assumed to be obtained in an image forming apparatus described later when intermediate transfer member 421 is incorporated in the image forming apparatus. In other words, when the melting point of the tertiary amine compound is 45° C. or more, even if intermediate transfer member 421 is continuously used in the HH environment of the image forming apparatus, the tertiary amine compound does not melt, and the bleed-out is not caused.

Besides, "65° C." is a drying temperature employed in production process of intermediate transfer member 421 described later. In other words, when the melting point of the tertiary amine compound is 65° C. or more, the tertiary amine compound does not melt during the drying step, and dispersion failure or the bleed-out is not caused after the drying step.

Furthermore, "95° C." is a temperature set considering that the lifetime is further increased, and that the intermediate transfer member can be suitably used even when continuously used in the HH environment. For example, even if the use temperature of intermediate transfer member 421 in a belt shape is lower than the melting point of the tertiary amine compound, the suppression of the bleed-out can be disadvantageously affected. Therefore, in order to suppress the bleed-out, it is effective to use intermediate transfer member 421 in a state where the molecule mobility is low. In other words, it is effective for suppressing the bleed-out to select a polyfunctional (meth)acrylate having a higher melting point. If the melting point of the tertiary amine compound is 95° C. or more, a production method applied to a highly heat resistant material or a production method applied to a solvent having a high boiling point can be applied, and hence, the production process can be less restricted.

Besides, it is preferable that the tertiary amine compound does not absorb the actinic radiation used for polymerizing the polyfunctional (meth)acrylate. If the tertiary amine compound absorbs the actinic radiation, the amount of the actinic radiation to be used by the photopolymerization initiator is relatively reduced. If the tertiary amine compound does not absorb the actinic radiation, the inhibition of the radical polymerization by oxygen can be suppressed without lowering the efficiency of the polymerization reaction.

Specifically, the tertiary amine compound is preferably a compound not having a fused polycyclic aromatic ring (such as naphthalene, anthracene or acridine) or a compound having a structure not including five or more continuous conjugated systems. In other words, an aromatic ring contained in the tertiary amine compound is preferably a benzene ring.

Besides, the tertiary amine compound is preferably a compound having good compatibility with the polyfunctional (meth)acrylate, and having high solubility in a solvent used in the resin composition. If the compatibility with the polyfunctional (meth)acrylate is good, the effect of suppressing oxygen by the polyfunctional (meth)acrylate, the photopolymerization initiator and the tertiary amine compound can be exhibited without causing phase separation before the polymerization.

In order to attain the compatibility with the polyfunctional (meth)acrylate, the tertiary amine compound preferably contains a functional group having appropriate polarity, such as a halogen group, a carbonyl group, an ester bond, or an ether bond. It is noted that such a functional group increases the melting point of the tertiary amine compound.

Besides, the tertiary amine compound preferably does not contain an extremely hydrophilic functional group. Specifically, an acidic/basic functional group excluding a tertiary amine, a hydroxyl group, an ionic functional group or a primary amide group unavoidably increases the compatibility of the tertiary amine compound. A tertiary amine compound having such a functional group is not preferred because it is difficult to attain compatibility with the polyfunctional (meth)acrylate when formed into the resin composition.

Examples of the tertiary amine compound include esters of methyl 4-dimethylaminobenzoate, 4-dimethylamino acetophenone, dimethylaminobenzoic acid, or diethylaminobenzoic acid and di- or higher-valent polyhydric alcohols. Examples of the di- or higher-valent polyhydric alcohols include ethylene glycol, propylene glycol, glycerin, butanetriol, pentaerythritol, 1,4-benzenedimethanol, 1,3-benzenedimethanol, 1,3,5-benzenetrimethanol, and 1,4-bis(2-hydroxyethyl)benzene.

Other examples of the tertiary amine compound include polyvalent esters of dimethylaminophenol or diethylaminophenol and polyvalent carboxylic acids. The dimethylaminophenol and the diethylaminophenol are respectively preferably in meta-form and para-form. Examples of the polyvalent carboxylic acids include oxalic acid, malonic acid, succinic acid, glutaric acid, adipic acid, propanetricarboxylic acid, butanetricarboxylic acid, butanetetracarboxylic acid, pentanetricarboxylic acid, pentanetetracarboxylic acid, methylsuccinic acid, methylglutaric acid, cyclopentanetetracarboxylic acid, camphor acid, cyclopentanedicarboxylic acid, isophthalic acid, and phenylenediacetic acid.

Still other examples of the tertiary amine compound include polyvalent esters of polyvalent phenols and dimethylaminobenzoic acid or diethylaminobenzoic acid.

The tertiary amine compound also includes the following compounds:

[Formula 4]

A-1

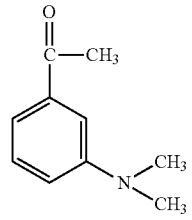

A-2

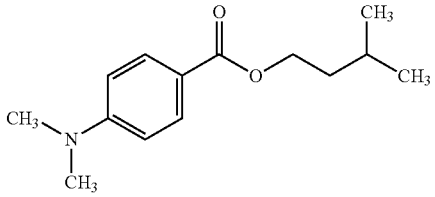

A-3

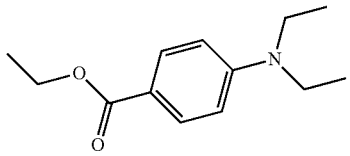

A-4

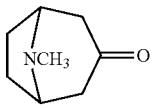

A-5

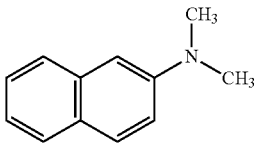

-continued
A-6
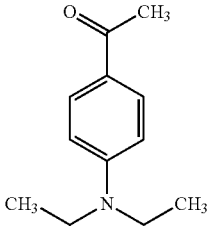
A-7
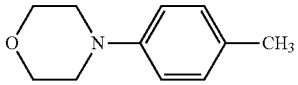
A-8
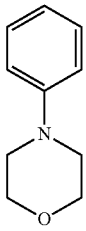
A-9
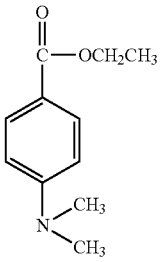
A-10
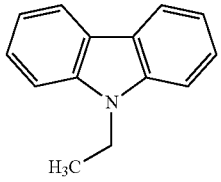
A-11
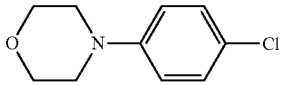
A-12
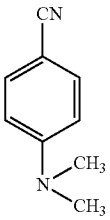
[Formula 5]
A-13
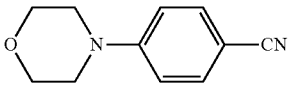
-continued
A-14
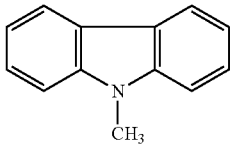
A-15
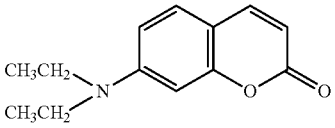
A-16
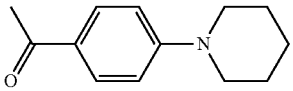
A-17
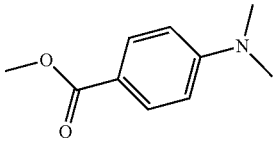
A-18
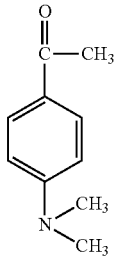
A-19
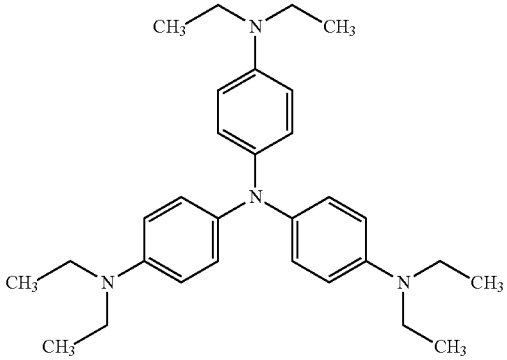
A-20
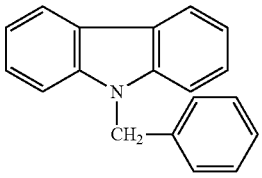
A-21
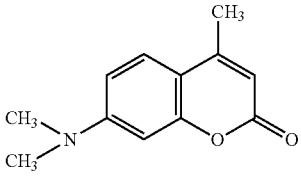

-continued
A-22
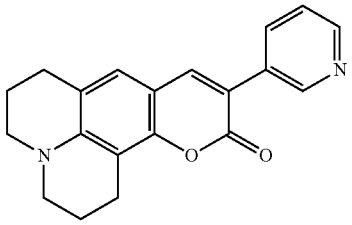
A-23
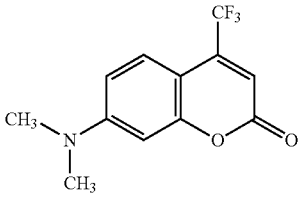
A-24
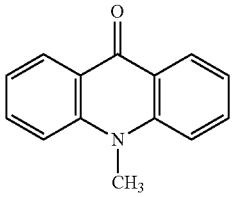
[Formula 6]
A-25
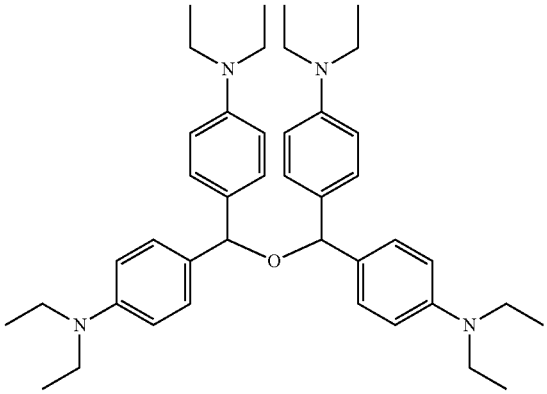
A-26
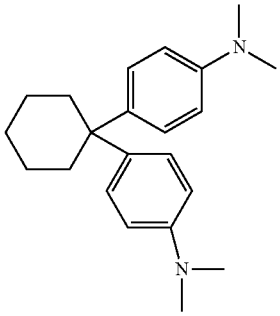
-continued
A-27
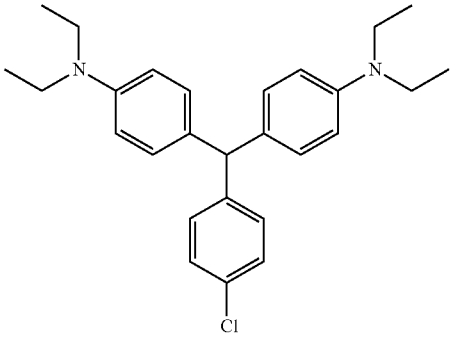
A-28
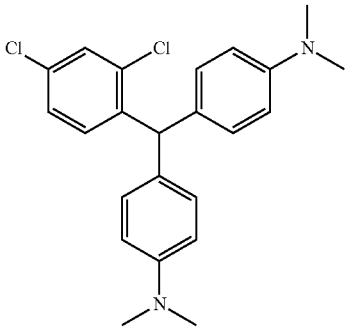
A-29
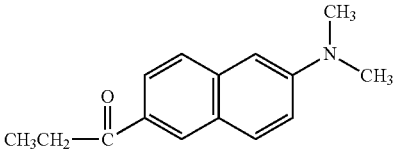
A-30
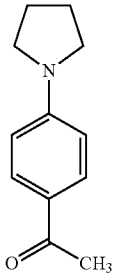
A-31
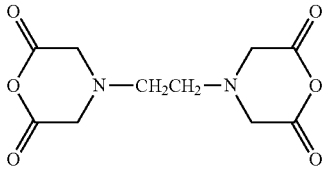
A-32
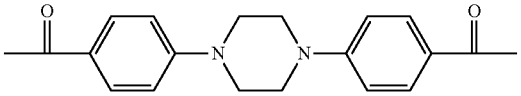
A-33
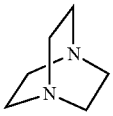

-continued

A-34

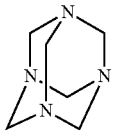

A-35

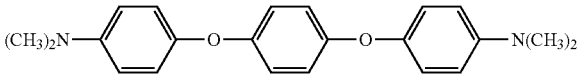

[Formula 7]

A-36

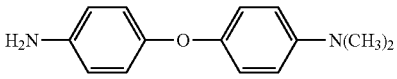

A-37

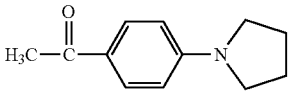

A-38

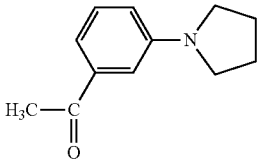

A-39

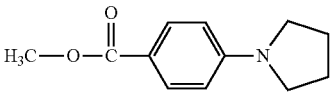

A-40

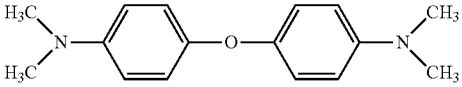

A-41

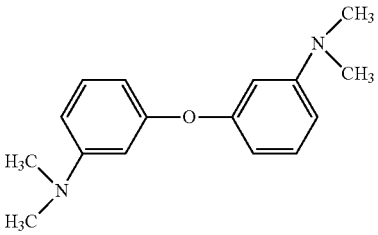

TABLE 1

| Compound No. | Melting Point (° C.) |
|---|---|
| A-1 | 37 |
| A-2 | 38 |
| A-3 | 41 |
| A-4 | 42 |
| A-5 | 46 |
| A-6 | 48 |
| A-7 | 50 |
| A-8 | 55 |
| A-9 | 65 |
| A-10 | 69 |
| A-11 | 73 |
| A-12 | 76 |
| A-13 | 85 |
| A-14 | 89 |
| A-15 | 89 |
| A-16 | 87 |
| A-17 | 97 |
| A-18 | 101 |

TABLE 1-continued

| Compound No. | Melting Point (° C.) |
|---|---|
| A-19 | 100 |
| A-20 | 100 |
| A-21 | 105 |
| A-22 | 119 |
| A-23 | 143 |
| A-24 | 165 |
| A-25 | 147 |
| A-29 | 138 |
| A-30 | 130 |
| A-31 | 190 (decomposed) |
| A-33 | 158 |
| A-34 | 280 |

As described above, from the viewpoint of the absorbance of light of a wavelength of the actinic radiation, the tertiary amine compound is preferably a compound having a benzene ring, and examples of the compound in which at least one aromatic group is bonded to the nitrogen atom include, as described above, the compounds A-1 to A-3, A-5 to A-18, A-20 to A-21 A-23, A-24, A-29, A-30, and A-37 to A-39.

Besides, from the viewpoint of attaining the compatibility with the polyfunctional (meth)acrylate, the tertiary amine compound is preferably a compound containing a functional group having appropriately polarity such as a halogen group, a carbonyl group, an ester bond or an ether bond, and the compounds A-1 to A-4, A-6 to A-9, A-11 to A-13, A-15 to A-18, A-21, A-23, A-24, A-29, A-30, A-31, and A-37 to A-39 are preferred.

Furthermore, the number of a group providing a tertiary amine in the tertiary amine compound may be one, or two or more. Examples of a compound in which the number of a group providing a tertiary amine is one include the compounds A-1 to A-18, A-21, A-23, A-24, A-29, A-30, and A-37 to A-39. Besides, examples of a compound in which the number of a group providing a tertiary amine is two or more include the compounds A-19, A-22, A-25 to A-28, A-31 to A-36, A-40, and A-41.

The compound in which the number of a group providing a tertiary amine is one will now be described in detail. In the compound in which the number of a group providing a tertiary amine is one, substituents bonded to the nitrogen atom may be independent of each other, or the nitrogen atom may be a part of a ring structure. If the nitrogen atom is a part of a ring structure in the compound, the ring structure may be a five-membered ring or a six-membered ring. Besides, two or more substituents forming the ring can be appropriately specified as long as formula (1) is satisfied.

Examples of a compound in which the substituents are independently bonded to the nitrogen atom include the compounds A-1 to A-3, A-5, A-6, A-9, A-12, A-15, A-17, A-18, A-21, A-23, and A-29. Examples of a compound in which the nitrogen atom is a part of the ring structure include the compounds A-4, A-7, A-8, A-10, A-11, A-13, A-14, A-16, A-20, A-22, A-24, A-30, A-31, and A-37 to A-39.

Examples of a compound in which the ring structure is a five-membered ring include the compounds A-4, A-10, A-14, A-20, A-30, and A-37 to A-39. Besides, examples of a compound in which the ring structure is a six-membered ring include the compounds A-7, A-8, A-11, A-13, A-16, A-22, A-24, and A-31.

In this manner, substituents R1 to R4 in formula (1) can have any of various structures as long as a tertiary amine compound having a melting point of 30° C. or more can be obtained. Accordingly, although this is not restrictive, the number of carbon atoms of R1 is, for example, preferably 1 to 15, and more preferably 6 to 10. The number of carbon atoms of R2 is, for example, preferably 1 to 12, and more preferably 1 to 7. The number of carbon atoms of R3 is, for example, preferably 0 to 10, and more preferably 0 to 2. The number of carbon atoms of R4 is, for example, preferably 0 to 4, and more preferably 0 to 2.

The tertiary amine compound may contain a tertiary amine unit in which each of R2 to R4 represents at least one divalent substituent. In the tertiary amine compound, tertiary amine units may be bonded to each other (as in, for example, the compounds A-31, A-32, A-35, A-33, and A-36), tertiary amine units may be bonded via a linking group (as in, for example, the compounds A-19, A-25 to A-28, A-40, and A-41), or a part of a tertiary amine unit may be shared between units (as in, for example, the compound A-34).

A content of the tertiary amine compound in surface layer 421*b* is preferably 0.1 mass % or more, and more preferably 0.5 mass % or more from the viewpoint of retaining the effect of suppressing the bleed-out. Besides, the content of the tertiary amine compound in surface layer 421*b* is preferably less than 15 mass %, more preferably less than 10 mass %, and further preferably less than 5.0 mass % from the viewpoint of suppressing the bleed-out of the tertiary amine itself, preventing strength lowering through plasticization of the surface layer, and preventing change in a transfer characteristic caused by an adverse reaction of the tertiary amine.

The tertiary amine compound contained in surface layer 421*b* can be detected by a known method, and can be identified by, for example, extraction with a solvent under a high temperature or high humidity condition, and subjecting the extraction solvent to LC/MS or GC/MS. Incidentally, when a tertiary amine compound having volatility is contained, the tertiary amine compound can be identified by subjecting a volatilized gas component to GC/MS. Alternatively, a tertiary amine compound incorporated in a cured product can be identified by detecting a pyrogram, a chromatogram, or an MS spectrum and by detecting an amine derivative by pyrolysis GC/MS or the like.

Surface layer 421*b* may contain a metal oxide fine particle (hereinafter sometimes referred to as the "surface-treated metal oxide fine particle") obtained by subjecting an untreated metal oxide fine particle (hereinafter sometimes simply referred to as the "metal oxide fine particle") to a surface treatment with a prescribed surface treating agent. The surface-treated metal oxide fine particle enhances the hardness of the surface layer.

The metal oxide fine particle is not particularly limited. Examples of the metal oxide fine particle include fine particles of silica (silicon oxide), magnesium oxide, zinc oxide, lead oxide, aluminum oxide (alumina), tantalum oxide, indium oxide, bismuth oxide, yttrium oxide, cobalt oxide, copper oxide, manganese oxide, selenium oxide, iron oxide, zirconium oxide, germanium oxide, tin oxide, titanium oxide, niobium oxide, molybdenum oxide and vanadium oxide. From the viewpoint of imparting toughness and durability, the metal oxide fine particle is preferably that of titanium oxide, aluminum oxide (alumina), zinc oxide or tin oxide, and further preferably aluminum oxide (alumina) or tin oxide.

The metal oxide fine particle to be used can be produced by a general production method such as a gas phase method, a chlorine method, a sulfuric acid method, a plasma method or an electrolytic method.

The metal oxide fine particle has a number average primary particle size of preferably 1 nm or more and 300 nm or less, and more preferably 3 to 100 nm. If the number average primary particle size is smaller than 1 nm, it is apprehended that sufficient abrasion resistance cannot be attained. On the other hand, if the number average primary particle size exceeds 300 nm, the dispersibility is so poor that the fine particle easily precipitates in a coating solution. Besides, there is a possibility that the particle impairs the light curing of surface layer 421*b* and hence sufficient abrasion resistance cannot be attained.

The number average primary particle size of the metal oxide fine particle can be obtained by taking a 10,000-fold enlarged photograph with a scanning electron microscope (JEOL Ltd.) and by subjecting photograph images of randomly selected 300 particles (excluding agglomerated particles) taken in using a scanner to calculation using an automatic image processing analyzing apparatus (LUZEXAP; Nireco Corporation) with software version of Ver. 1.32.

On the other hand, the surface-treated metal oxide fine particle carries, on a surface thereof, a carried substance having a radically polymerizable functional group. The carried substance may be chemically bonded to or physically adsorbed on the surface of the metal oxide fine particle. An example of the radically polymerizable functional group includes a (meth)acryloyl group. Here, the term "(meth) acryloyl group" means an acryloyl group or a methacryloyl group. An example of a surface treating agent to be used for producing a surface-treated metal oxide fine particle having a (meth)acryloyl group includes a compound having a (meth)acryloyl group.

The compound having a (meth)acryloyl group is preferably a compound having, in one molecule, a radically polymerizable functional group, such as a carbon-carbon double bond, and a polar group, such as an alkoxy group, to be coupled to a hydroxy group present on the surface of the metal oxide fine particle.

It is preferable that the compound having a (meth)acryloyl group is polymerized (cured) through irradiation with actinic radiation such as ultraviolet rays or electron beams to form a resin such as polystyrene or a poly(meth)acrylate. Incidentally, the compound having a (meth)acryloyl group is chemically strongly bonded to the metal oxide fine particle through a simple operation.

An example of the compound having a (meth)acryloyl group includes a compound represented by the following formula (3):

[Formula 8]

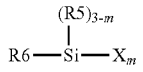

(3)

In formula (3), R5 independently represents a hydrogen atom, an alkyl group having 1 to 10 carbon atoms, or an aralkyl group having 1 to 10 carbon atoms, R6 represents an organic group having a radically polymerizable functional group, X independently represents a halogen atom, an alkoxy group, an acyloxy group, an aminooxy group or a phenoxy group, and m represents an integer of 1 to 3.

Other examples of the compound having a (meth)acryloyl group include compounds represented by the following formulas S-1 to S-33:

$CH_2{=}CHSi(CH_3)(OCH_3)_2$ S-1:

$CH_2{=}CHSi(OCH_3)_3$ S-2:

$CH_2{=}CHSiCl_3$ S-3:

$CH_2{=}CHCOO(CH_2)_2Si(CH_3)(OCH_3)_2$ S-4:

$CH_2{=}CHCOO(CH_2)_2Si(OCH_3)_3$ S-5:

$CH_2{=}CHCOO(CH_2)_3Si(CH_3)(OCH_3)_2$ S-6:

$CH_2{=}CHCOO(CH_2)_3Si(OCH_3)_3$ S-7:

$CH_2{=}CHCOO(CH_2)_2Si(CH_3)Cl_2$ S-8:

$CH_2{=}CHCOO(CH_2)_2SiCl_3$ S-9:

$CH_2{=}CHCOO(CH_2)_3Si(CH_3)Cl_2$ S-10:

$CH_2{=}CHCOO(CH_2)_3SiCl_3$ S-11:

$CH_2{=}C(CH_3)COO(CH_2)_2Si(CH_3)(OCH_3)_2$ S-12:

$CH_2{=}C(CH_3)COO(CH_2)_2Si(OCH_3)_3$ S-13:

$CH_2{=}C(CH_3)COO(CH_2)_3Si(CH_3)(OCH_3)_2$ S-14:

$CH_2{=}C(CH_3)COO(CH_2)_3Si(OCH_3)_3$ S-15:

$CH_2{=}C(CH_3)COO(CH_2)_2Si(CH_3)Cl_2$ S-16:

$CH_2{=}C(CH_3)COO(CH_2)_2SiCl_3$ S-17:

$CH_2{=}C(CH_3)COO(CH_2)_3Si(CH_3)Cl_2$ S-18:

$CH_2{=}C(CH_3)COO(CH_2)_3SiCl_3$ S-19:

$CH_2{=}CHSi(C_2H_5)(OCH_3)_2$ S-20:

$CH_2{=}C(CH_3)Si(OCH_3)_3$ S-21:

$CH_2{=}C(CH_3)Si(OC_2H_5)_3$ S-22:

$CH_2{=}CHSi(OCH_3)_3$ S-23:

$CH_2{=}C(CH_3)Si(CH_3)(OCH_3)_2$ S-24:

$CH_2{=}CHSi(CH_3)Cl_2$ S-25:

$CH_2{=}CHCOOSi(OCH_3)_3$ S-26:

$CH_2{=}CHCOOSi(OC_2H_5)_3$ S-27:

$CH_2{=}C(CH_3)COOSi(OCH_3)_3$ S-28:

$CH_2{=}C(CH_3)COOSi(OC_2H_5)_3$ S-29:

$CH_2{=}C(CH_3)COO(CH_2)_3Si(OC_2H_5)_3$ S-30:

$(SH)CH_2CH_2COOSi(OCH_3)_3$ S-31:

$(SH)CH(CH_3)CH_2COOSi(OCH_3)_3$ S-32:

$(SH)CH(CH_3)OCOO(CH_2)_3Si(OC_2H_5)_3$ S-33:

Still other examples of the compound having a (meth) acryloyl group include compounds represented by the following formulas (S-34) to (S-37):

[Formula 9]

(S-34)

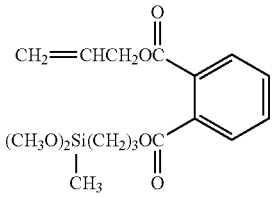

(S-35)

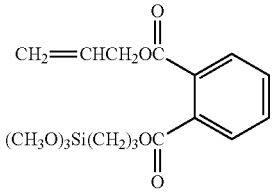

(S-36)

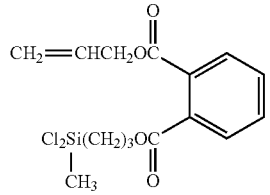

(S-37)

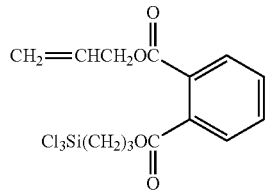

Alternatively, the compound having a (meth)acryloyl group may be an epoxy-based compound. Examples of such a compound having a (meth)acryloyl group include compounds represented by the following formulas (S-38) to (S-40):

[Formula 10]

(S-38)

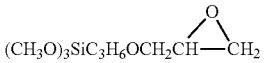

(S-39)

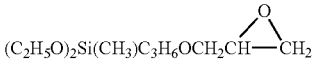

(S-40)

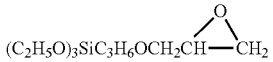

As a method for producing the surface-treated metal oxide fine particle, for example, a method in which 100 parts by mass of the metal oxide fine particle, 0.1 to 200 parts by mass of a surface treating agent, and 50 to 5,000 parts by mass of a solvent are mixed using a wet-type medium dispersing apparatus may be employed.

Alternatively, as another method for producing the surface-treated metal oxide fine particle, for example, a method in which a slurry (a suspension of a solid particle) containing the metal oxide fine particle and a surface treating agent is stirred may be employed. During the stirring, an aggregate of the metal oxide fine particle is crushed, and at the same time, a surface treatment of the metal oxide fine particle proceeds. Thereafter, the metal oxide fine particle is taken out by removing the solvent. Thus, the surface treated metal oxide fine particle having been homogeneously and finely surface treated with the surface treating agent can be obtained.

A surface treatment amount of the surface treating agent (i.e., a coating amount of the surface treating agent in the metal oxide fine particle) is preferably 0.1 to 60 mass %, and particularly preferably 5 to 40 mass % with respect to the metal oxide fine particle.

The wet-type medium dispersing apparatus refers to an apparatus including beads filled as a medium in a vessel and a stirring disc attached vertically to a rotation axis so that a crushing/dispersing step can be executed by crushing aggregated particles of the metal oxide fine particle by rapidly rotating the stirring disc. The wet-type medium dispersing apparatus is not particularly limited as long as the metal oxide fine particle can be sufficiently dispersed as well as can be surface treated during the surface treatment of the metal oxide fine particle, and any one of various types such as vertical or lateral types and continuous or batch types can be employed. Specifically, a sand mill, an Ultra Visco Mill, a pearl mill, a grain mill, a Dyno mill, an agitator mill, a dynamic mill or the like can be used.

In such a dispersing apparatus, fine grinding and dispersion are carried out through impact crushing, rubbing, shearing and application of shearing stress using a grinding medium (medium) such as a ball or a bead. As the bead to be used in the dispersing apparatus, balls made of raw materials of glass, alumina, zircon, zirconia, steel and flint stone can be used, but a bead made of zirconia or zircon is particularly preferred. Besides, as the size of the bead, one having a diameter of about 1 to 2 mm is generally used, and one having a diameter of about 0.3 to 1.0 mm is preferably used in the present embodiment.

A content of the surface-treated metal oxide fine particle in surface layer 421*b* is preferably 5 parts by volume or more, and more preferably 10 parts by volume or more so as to prevent the hardness of intermediate transfer member 421 from lowering and to prevent the transferability and the durability from degrading. Besides, the content of the surface-treated metal oxide fine particle in surface layer 421*b* is preferably 40 parts by volume or less, and more preferably 30 parts by volume or less so as to prevent surface layer 421*b* from becoming fragile and to prevent coating irregularities from being caused during the production described later.

Surface layer 421*b* may further contain an additional additive. An additive is appropriately added to surface layer 421*b* through, for example, addition to a resin composition. The additional additive may be added to the resin composition for imparting an appropriate physical property in the production of surface layer 421*b*. Examples of the additional additive include an organic solvent, a light stabilizer, a UV absorber, a catalyst, a colorant, an antistatic agent, a lubricant, a leveling agent, an antifoaming agent, a polymerization promoter, an antioxidant, a flame retardant, an infrared absorber, a surfactant and a surface modifier.

Here, a mechanism by which intermediate transfer member 421 of the present embodiment can suppress the increase in the dynamic friction force over time will be described. Since intermediate transfer member 421 contains the tertiary amine compound in which at least one hydrogen atom is bonded to one carbon atom out of three carbon atoms bonded to a nitrogen atom, the influence of oxygen on the polymerization reaction otherwise caused during the production process is suppressed to increase a reaction rate of the polymerization. Specifically, this mechanism is attained probably because the tertiary amine compound traps oxygen present in the atmosphere as shown in the following formula (4):

[Formula 11]

formula (4)

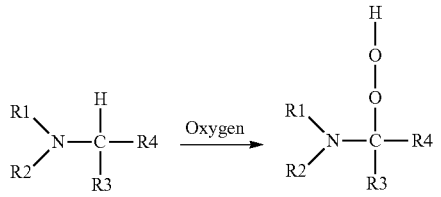

As a result, the increase in the dynamic friction force owing to a residual monomer and a residual oligomer can be suppressed to improve cleaning reliability. Besides, since the bleed-out can be also prevented by specifying, depending on the melting point, a tertiary amine compound that cannot be used as a solvent, the effects of the present invention can be further improved.

Incidentally, it is presumed that a primary amine or a secondary amine traps even a radical necessary for the reaction to make insufficient the effect of improving the reaction rate. Alternatively, if, for example, triphenylamine or the like is used, it is presumed that the oxygen trapping effect as shown in formula (4) cannot be attained, and hence the effect of improving the reaction rate becomes insufficient. Besides, although a tertiary amine compound having a melting point lower than 30° C. can achieve the effect of increasing the reaction rate, such a compound melts to dissolve a residual monomer and a residual oligomer therein in the HH environment to cause the bleed-out, and hence, the increase in the dynamic friction force cannot be suppressed in the HH environment.

(Method for Producing Intermediate Transfer Member)

A method for producing an intermediate transfer member includes a step of forming, on a substrate layer, a coating film of a resin composition containing a polyfunctional (meth)acrylate, a photopolymerization initiator, and a tertiary amine compound having a melting point of 30° C. or more; and a step of forming a surface layer on the substrate layer by causing radical polymerization of the polyfunctional (meth)acrylate contained in the coating film.

The substrate layer can be produced by any of known general methods. For example, a heat resistant resin used as a material is melted using an extruder, the melt resin is formed into a cylindrical shape by an inflation method using a ring die, and the resultant is cross-sectionally cut to produce substrate layer 421*a* in a ring shape (an endless belt shape).

In the step of forming the coating film of the resin composition on the substrate layer, the coating film is formed by applying the resin composition, obtained by adding the respective components to a solvent, onto the substrate layer in a prescribed thickness by using a coating machine. The resultant coating film is dried, and irradiated with actinic radiation for polymerizing the polyfunctional (meth)acrylate, and thus, the surface layer can be formed. Incidentally, the above-described tertiary amine compound having a melting point of 30° C. or more in which at least one hydrogen atom is bonded to one carbon atom out of three carbon atoms bonded to a nitrogen atom is used as the tertiary amine compound.

Examples of the solvent to be used in the resin composition include methanol, ethanol, n-propyl alcohol, isopropyl alcohol, n-butanol, t-butanol, sec-butanol, benzyl alcohol, toluene, xylene, methylene chloride, methyl ethyl ketone, cyclohexane, ethyl acetate, butyl acetate, methyl cellosolve, ethyl cellosolve, tetrahydrofuran, 1-dioxane, 1,3-dioxolane, pyridine and diethylamine.

Conditions for drying can be appropriately selected in accordance with the type of solvent, the layer thickness and the like. The drying temperature is preferably room temperature to 180° C., more preferably 40 to 160° C., and further preferably 60 to 140° C. Besides, the drying time is preferably 1 to 200 minutes, and more preferably 5 to 100 minutes.

As a method for applying the resin composition, any of known methods such as a dip coating method, a spray coating method, a spinner coating method, a bead coating method, a blade coating method, a beam coating method, and a slide hopper method can be employed.

The actinic radiation is preferably ultraviolet rays. As a source of ultraviolet rays, any light source generating ultraviolet rays can be unrestrictedly used. For example, a low-pressure mercury lamp, a medium-pressure mercury lamp, a high-pressure mercury lamp, an ultra-high-pressure mercury lamp, a carbon arc lamp, a metal halide lamp, a xenon lamp, a flash (pulse) xenon lamp or the like can be used. Although irradiation conditions vary depending on a lamp to be used, the irradiation dose of the actinic radiation is generally 5 to 500 mJ/cm$^2$, and preferably 5 to 100 mJ/cm$^2$. The power of the lamp is preferably 0.1 to 5 kW, and particularly preferably 0.5 to 3 kW.

The irradiation time for attaining a necessary irradiation dose of the actinic radiation is preferably 0.1 second to 10 minutes, and from the viewpoint of work efficiency, it is more preferably 0.1 second to 5 minutes.

(Structure of Image Forming Apparatus)

Figure 2:
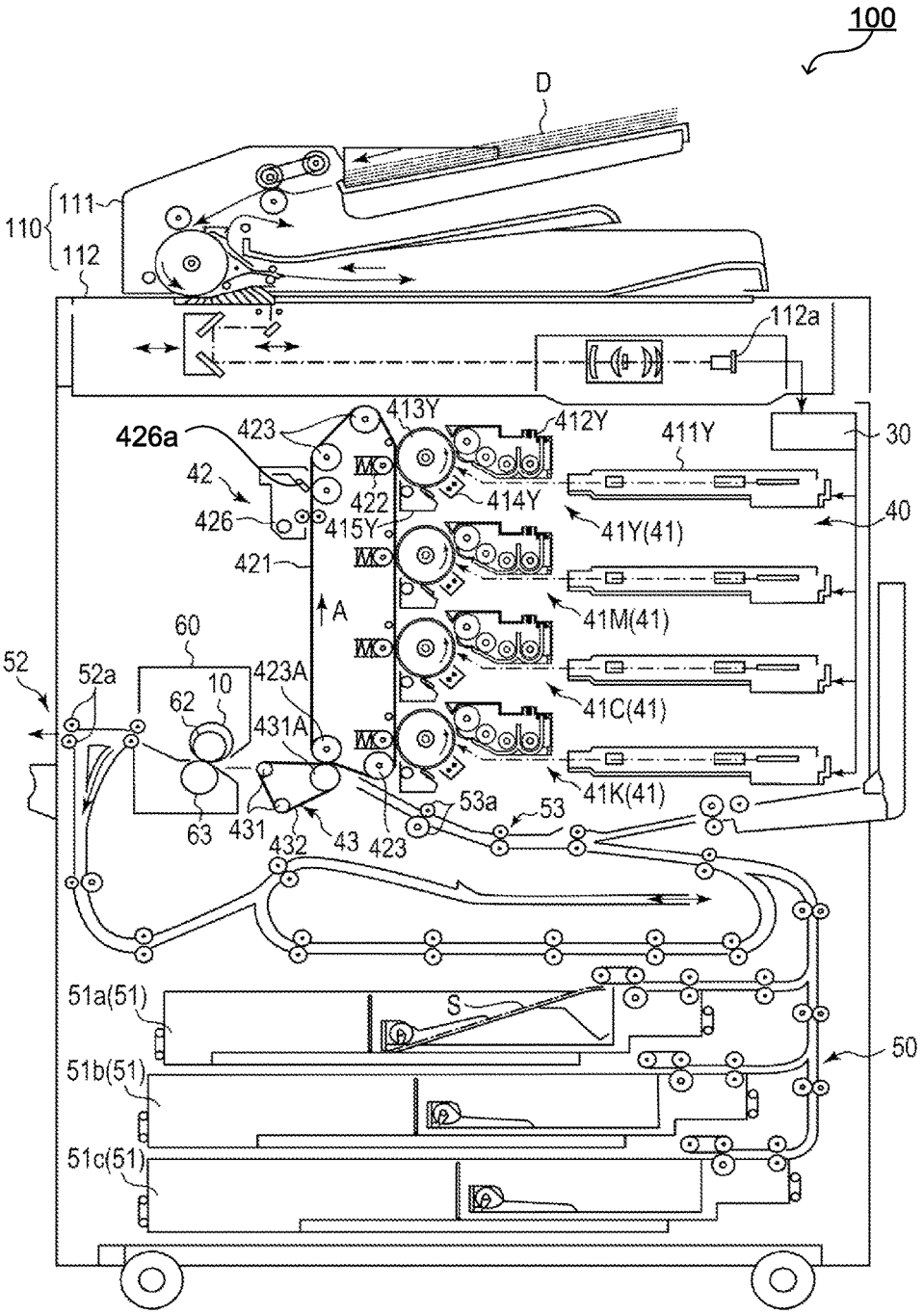
FIG. 2 is a diagram illustrating a structure of an image forming apparatus according to one embodiment of the present invention.

FIG. 2 is a schematic diagram illustrating an example of the structure of an image forming apparatus including an intermediate transfer member. Image forming apparatus 100 illustrated in FIG. 2 includes image reading section 110, image processing section 30, image forming section 40, sheet conveying section 50 and fixing apparatus 60.

Image forming section 40 includes image forming units 41Y, 41M, 41C and 41K respectively forming images of color toners of Y (yellow), M (magenta), C (cyan) and K (black). Since these units have the same structure excluding the color of the toner contained therein, a sign corresponding to the color may be sometimes omitted in the following description. Image forming section 40 further includes intermediate transfer unit 42 and secondary transfer unit 43. These units correspond to a transfer apparatus.

Each image forming unit 41 includes exposing apparatus 411, developing apparatus 412, electrophotographic photoconductor 413, charging apparatus 414 and drum cleaning apparatus 415. Charging apparatus 414 is, for example, a corona charger. Charging apparatus 414 may be a contact charging apparatus that charges electrophotographic photoconductor 413 with a contact charging member such as a charging roller, a charging brush or a charging blade brought into contact with electrophotographic photoconductor 413. Exposing apparatus 411 includes, for example, a semiconductor laser working as a light source, and a light deflection apparatus (a polygon motor) for irradiating electrophotographic photoconductor 413 with a laser beam in accordance with an image to be formed.

Developing apparatus 412 is a developing apparatus employing a two-component developing method. Developing apparatus 412 includes, for example, a developer container containing a two-component developer, a developing roller (a magnetic roller) disposed rotatably in an opening of the developer container, a partition for partitioning the developer container so that the two-component developer can pass therethrough, a conveyance roller for conveying a portion of the two-component developer disposed on a side of the opening of the developer container toward the developing roller, and a stirring roller for stirring the two-component developer contained in the developer container.

Intermediate transfer unit 42 includes intermediate transfer belt (intermediate transfer member) 421, primary transfer roller 422 pressing intermediate transfer belt 421 against electrophotographic photoconductor 413, a plurality of supporting rollers 423 including backup roller 423A, and belt cleaning apparatus 426. Intermediate transfer belt 421 is stretched over plural supporting rollers 423 in the shape of a loop. At least one driving roller out of plural supporting rollers 423 is rotated, and thus, intermediate transfer belt 421 is caused to run at a constant speed in a direction of arrow A.

Belt cleaning apparatus 426 includes elastic member 426*a*. Elastic member 426*a* comes into contact with intermediate transfer belt 421 after secondary transfer, so as to remove a substance adhering to the surface of intermediate transfer belt 421. Elastic member 426*a* is made of an elastic material, and includes a cleaning blade, a brush or the like.

Secondary transfer unit 43 includes endless secondary transfer belt 432, and a plurality of supporting rollers 431 including secondary transfer roller 431A. Secondary transfer belt 432 is stretched over secondary transfer roller 431A and supporting rollers 431 in the shape of a loop.

Fixing apparatus 60 includes, for example, fixing roller 62, endless heating belt 10 covering the outer peripheral surface of fixing roller 62 for heating and melting a toner forming a toner image on sheet S, and pressing roller 63 for pressing sheet S against fixing roller 62 and heating belt 10. Sheet S corresponds to a recording medium.

Image forming apparatus 100 further includes image reading section 110, image processing section 30, and sheet conveying section 50. Image reading section 110 includes sheet feeding apparatus 111 and scanner 112. Sheet conveying section 50 includes sheet feeding section 51, sheet ejecting section 52, and conveyance path section 53. Three sheet feed tray units 51*a* to 51*c* included in sheet feeding section 51 hold respective types of sheets S (including a standard sheet and a special sheet) precedently set and identified based on the weight, the size and the like. Conveyance path section 53 includes a plurality of conveyance roller pairs such as registration roller pair 53*a*.

Image formation performed by image forming apparatus 100 will now be described.

Scanner 112 reads, by optically scanning, original D placed on a contact glass. Reflected light from original D is read by CCD sensor 112*a* and converted into input image data. The thus obtained input image data is subjected to prescribed image processing in image processing section 30, and the resultant is transferred to exposing apparatus 411.

Electrophotographic photoconductor 413 rotates at a constant peripheral speed. Charging apparatus 414 uniformly negatively charges the surface of electrophotographic photoconductor 413. In exposing apparatus 411, a polygon mirror of the polygon motor rotates at a high speed, a laser beam corresponding to each color component of the input image data is developed along an axial direction of electrophotographic photoconductor 413 to irradiate the outer peripheral surface of electrophotographic photoconductor 413 along the axial direction. Thus, an electrostatic latent image is formed on the surface of electrophotographic photoconductor 413.

In developing apparatus 412, a toner particle is charged by stirring and conveying the two-component developer in the developer container, and the two-component developer is conveyed toward the developing roller and forms a magnetic brush on the surface of the developing roller. The charged toner particle electrostatically adheres, from the magnetic brush, to a portion of the electrostatic latent image on electrophotographic photoconductor 413. Thus, the electrostatic latent image on the surface of electrophotographic photoconductor 413 is visualized, and a toner image corresponding to the electrostatic latent image is formed on the surface of electrophotographic photoconductor 413. It is noted that the term "toner image" refers to a state where the toner is collected in the form of an image.

The toner image formed on the surface of electrophotographic photoconductor 413 is transferred onto intermediate transfer belt 421 by intermediate transfer unit 42. A transfer residual toner remaining after the transfer on the surface of electrophotographic photoconductor 413 is removed by drum cleaning apparatus 415 having a drum cleaning blade brought into sliding contact with the surface of electrophotographic photoconductor 413.

Since intermediate transfer belt 421 is pressed against electrophotographic photoconductor 413 by primary transfer roller 422, a primary transfer nip is formed with respect to each electrophotographic photoconductor between electrophotographic photoconductor 413 and intermediate transfer belt 421. In this primary transfer nip, toner images of the respective colors are successively transferred onto intermediate transfer belt 421 in a superimposed manner.

On the other hand, secondary transfer roller 431A is pressed against backup roller 423A via intermediate transfer belt 421 and secondary transfer belt 432. Thus, a secondary transfer nip is formed between intermediate transfer belt 421 and secondary transfer belt 432. Sheet S passes through the secondary transfer nip. Sheet S is conveyed to the secondary transfer nip by sheet conveying section 50. Correction in skew of sheet S and adjustment of conveyance timing are performed by a registration roller section including registration roller pair 53*a*.

An adhering substance such as a transfer residual toner remaining on the surface of intermediate transfer belt 421 after secondary transfer is removed by belt cleaning apparatus 426 including a cleaning blade brought into sliding contact with the surface of intermediate transfer belt 421. Here, the above-described intermediate transfer member is used as the intermediate transfer belt, and therefore, the dynamic friction force can be reduced over time.

When sheet S is conveyed to the secondary transfer nip, a transfer bias is applied to secondary transfer roller 431A. Owing to the application of the transfer bias, the toner image born on intermediate transfer belt 421 is transferred onto sheet S. Sheet S onto which the toner image has been transferred is conveyed toward fixing apparatus 60 by secondary transfer belt 432.

Fixing apparatus 60 forms a fixing nip between heating belt 10 and pressing roller 63, and heats and presses sheet S conveyed thereto in the fixing nip section. In this manner, the toner image is fixed on sheet S. Sheet S on which the toner image has been fixed is ejected outside the apparatus by sheet ejecting section 52 including sheet ejection rollers 52*a*.

Thus, since intermediate transfer belt 421 described above is used in the present embodiment, the increase in the dynamic friction force otherwise caused between elastic member 426*a* and intermediate transfer belt 421 over time can be suppressed.

As is obvious from the description made so far, an intermediate transfer member includes a resin substrate layer and a surface layer disposed on the substrate layer, the surface layer is made of a cured product of a resin composition containing a polyfunctional (meth)acrylate, a photopolymerization initiator, and a tertiary amine compound having a melting point of 30° C. or more, and in the tertiary amine compound, at least one hydrogen atom is bonded to one carbon atom out of three carbon atoms bonded to a nitrogen atom. Accordingly, in the intermediate transfer member, the increase in the dynamic friction force can be suppressed over a long period of time.

Besides, it is more effective, from the viewpoint of increasing the melting point, that at least one aromatic group is bonded to the nitrogen atom of the tertiary amine compound.

It is further effective, from the viewpoint that the production process is less restricted, that the melting point of the tertiary amine compound is 45° C. or more, 65° C. or more, or 100° C. or more.

It is further effective, from the viewpoint of more effectively performing the radical polymerization, that the photopolymerization initiator has a phosphine oxide skeleton or an oxime ester skeleton.

It is further effective, from the viewpoint of increasing the hardness of the intermediate transfer member, that the surface layer includes a metal oxide fine particle carrying, on a surface thereof, a carried substance having a radically polymerizable functional group, and that the radically polymerizable functional group is a (meth)acryloyl group.

A production method for an intermediate transfer member is a method for producing an intermediate transfer member including a resin substrate layer and a surface layer disposed on the substrate layer, and includes a step of forming, on the substrate layer, a coating film of a resin composition containing a polyfunctional (meth)acrylate, a photopolymerization initiator and a tertiary amine compound having a melting point of 30° C. or more; and a step of forming, on the substrate layer, the surface layer by causing radical polymerization of the polyfunctional (meth)acrylate contained in the coating film, and a compound in which at least one hydrogen atom is bonded to one carbon atom out of three carbon atoms bonded to a nitrogen atom is used as the tertiary amine compound. Accordingly, an intermediate transfer member capable of suppressing the increase in dynamic friction force over time can be produced by the production method.

An image forming apparatus includes an intermediate transfer member for bearing and transferring a toner image having been born on a photoconductor onto a recording medium, and a cleaning apparatus for removing an adhering substance from the surface of the intermediate transfer member, the intermediate transfer member is the above-described intermediate transfer member, and the cleaning apparatus includes an elastic member to be brought into contact with the surface of the intermediate transfer member for removing the adhering substance. Accordingly, in the intermediate transfer member, the increase in the dynamic friction force can be suppressed over a long period of time, and hence, a high-quality image can be provided over a long period of time.

Examples

1. Production of Intermediate Transfer Member (1) Production of Intermediate Transfer Member 1

A. Production of Substrate Layer

A single shaft extruder was charged with the following components in the following amounts, and the components were melted and mixed to obtain a resin mixture. As a polyphenylene sulfide, E2180 (Toray Industries, Inc.) was used. As a conductive filler, carbon black (#3030B; Mitsubishi Chemical Corporation) was used. As a graft copolymer, Modiper (R) A4400 (Nippon Oil & Fats Co., Ltd.) was used. As a lubricant, calcium montanate was used.

| | |
|---|---|
| Polyphenylene sulfide | 100 parts by volume |
| Conductive filler | 16 parts by volume |
| Graft copolymer | 1 part by volume |
| Lubricant | 0.2 parts by volume |

Next, a ring die having a slit discharge port in the shape of a seamless belt was attached to the tip of the single shaft extruder. The resin mixture obtained was extruded into the shape of a seamless belt. Subsequently, the resin mixture having been extruded into the seamless belt shape was cooled and cured by externally inserting into a cylindrical cooling tube provided in a position where the mixture was discharged, and thus, a substrate layer for an intermediate transfer member in a seamless cylindrical shape (an endless belt shape) having a thickness of 120 μm was produced.

B. Preparation of Surface-Treated Metal Oxide Fine Particle

The following components were mixed in the following amounts, the resultant was dispersed by using a wet-type medium dispersing apparatus, and then the solvent was removed therefrom. Subsequently, the resultant was dried at 150° C. for 30 minutes to obtain a surface-treated tin oxide particle as a surface-treated metal oxide fine particle. As a surface treating agent, 3-acryloxypropyltrimethoxysilane (KBM-5103; Shin-Etsu Chemical Co., Ltd.) was used. As a solvent, a mixed solvent of toluene and isopropyl alcohol in a volume ratio of 1:1 was used.

| | |
|---|---|
| Tin oxide fine particle (average particle size of 34 nm) | 100 parts by volume |
| Surface treating agent | 15 parts by volume |
| Solvent | 400 parts by volume |

C. Preparation of Resin Composition

A resin composition was prepared by dissolving and dispersing, in a solvent, methyl isobutyl ketone (MIBK), the following components in the following amounts to a solid concentration of 10 mass % under an environment where light of a wavelength of 450 nm was cut. As photopolymerization initiator 1, Irgacure (R) 819 (BASF) (containing bis-(2,4,6-trimethoxybenzoyl)-phenylphosphine oxide), that is, a commercially available acyl phosphine oxide-based photopolymerization initiator was used.

| | |
|---|---|
| Polyfunctional (meth)acrylate (P-1) | 75 parts by volume |
| Surface-treated metal oxide fine particle | 25 parts by volume |

-continued

| | |
|---|---|
| Photopolymerization initiator (photopolymerization initiator 1) | 3 parts by volume |
| Tertiary amine compound (A-3) | 1.5 parts by volume |

D. Formation of Surface Layer

A coating film was formed on the outer peripheral surface of the substrate layer by applying the resin composition into a dry thickness of 4 μm by a dip coating method using a coating apparatus (supplied amount of coating solution: 1 L/min). Next, the thus formed coating film was irradiated with ultraviolet rays used as actinic radiation (active energy rays) under the following irradiation conditions, so as to cure the coating film to form a surface layer. In this manner, intermediate transfer member No. 1 was obtained. Incidentally, the irradiation with ultraviolet rays was performed with a light source fixed while rotating a precursor including the coating film formed on the outer peripheral surface of the resin substrate layer at a peripheral speed of 60 mm/s.

(Conditions for Ultraviolet Rays Irradiation)

Light Source: 365 nm LED light source (SPX-TA; Eye Graphics Co., Ltd.)

Distance between Irradiation Port and Surface of Coating Film: 40 mm

Atmosphere: nitrogen (oxygen concentration in atmosphere: 600 ppm)

Irradiation Intensity: 1.25 J/cm$^2$

Irradiation Time (Time of rotating precursor): 300 seconds (2) Production of Intermediate Transfer Members 2 to 6 and 10 to 12

Intermediate transfer members 2 to 6 and 10 to 12 were produced in the same manner as intermediate transfer member 1 except that tertiary amine compound (A-3) was changed respectively to tertiary amine compounds (A-6, A-10, A-17, A-21, A-33, a-1, a-2, and a-3). It is noted that triphenyl amine was used as compound a-1. Besides, the following amine compound was used as compound a-2. Furthermore, triethylamine was used as compound a-3.

[Formula 12]

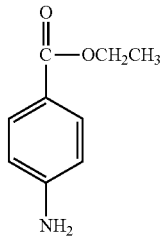

(3) Production of Intermediate Transfer Member 7

Intermediate transfer member 7 was produced in the same manner as intermediate transfer member 1 except that polyfunctional (meth)acrylate (P-1) was changed to polyfunctional (meth)acrylate (P-2), that photopolymerization initiator 1 was changed to photopolymerization initiator 2, and that tertiary amine compound (A-3) was changed to tertiary amine compound (A-6). As photopolymerization initiator 2, Irgacure (R) OXE01 (manufactured by BASF) (containing 1,2-octanedione,1-[4-(phenylthio) phenyl-,2-(o-benzoyloxime)]), that is, a commercially available oxime ester-based photopolymerization initiator, was used.

(4) Production of Intermediate Transfer Member 8

Intermediate transfer member 8 was produced in the same manner as intermediate transfer member 1 except that polyfunctional (meth)acrylate (P-1) was changed to polyfunctional (meth)acrylate (P-2), that photopolymerization initiator 1 was changed to photopolymerization initiator 3, and that tertiary amine compound (A-3) was changed to tertiary amine compound (A-10). As photopolymerization initiator 3, Irgacure (R) OXE02 (manufactured by BASF) (containing ethanone 1-[9-ethyl-6-(2-methylbenzoyl)-9H-carbazol-3-yl]-1,1-(o-acetyloxime)), that is, a commercially available oxime ester-based photopolymerization initiator, was used.

(5) Production of Intermediate Transfer Member 9

Intermediate transfer member 9 was produced in the same manner as intermediate transfer member 1 except that polyfunctional (meth)acrylate (P-1) was changed to polyfunctional (meth)acrylate (P-3), that photopolymerization initiator 1 was changed to photopolymerization initiator 3, and that tertiary amine compound (A-3) was changed to tertiary amine compound (A-17).

(6) Production of Intermediate Transfer Member 13

Intermediate transfer member 13 was produced in the same manner as intermediate transfer member 1 except that no tertiary amine compound was added.

The polyfunctional (meth)acrylates, the photopolymerization initiators and the tertiary amine compounds used in the production of intermediate transfer members 1 to 13 are shown in Table 2 below.

TABLE 2

| | Intermediate Transfer Member No. | Polyfunctional (Meth)acrylate No. | Photopolymerization Initiator No. | Tertiary Amine Compound No. |
|---|---|---|---|---|
| Example | 1 | P-1 | 1 | A-3 |
| | 2 | P-1 | 1 | A-6 |
| | 3 | P-1 | 1 | A-10 |
| | 4 | P-1 | 1 | A-17 |
| | 5 | P-1 | 1 | A-21 |
| | 6 | P-1 | 1 | A-33 |
| | 7 | P-2 | 2 | A-6 |
| | 8 | P-2 | 3 | A-10 |
| | 9 | P-3 | 3 | A-17 |
| Comparative Example | 10 | P-1 | 1 | a-1 |
| | 11 | P-1 | 1 | a-2 |
| | 12 | P-1 | 1 | a-3 |
| | 13 | P-1 | 1 | — |

3. Evaluation

Intermediate transfer members 1 to 13 produced as described above were subjected to the following tests to evaluate for the following evaluation items.

(1) Measurement of Reaction Rate

A Fourier transform infrared spectrometer (Thermo Fisher Scientific) was used to obtain an IR spectrum under the following conditions to measure an intensity ratio of a C═C stretching peak derived from the polyfunctional acrylate used as the raw material. A reaction rate was calculated in accordance with the following formula, and was evaluated based on the following criteria:

Reaction rate %=100×[(C═C stretching peak height of coating film immediately before curing)−(C═C stretching peak height of final product obtained after reaction)]/(C═C stretching peak height of coating film immediately before curing)

A: The reaction rate was 90% or more.

B: The reaction rate was 85% or more and less than 90%.

C: The reaction rate was less than 85%.

(2) Evaluation of Dynamic Friction Force (Torque)

The humidity was controlled for 24 hours to attain the HH environment (30° C. and 80% RH), and an intermediate transfer unit for a commercially available full-color multifunctional peripheral (Bizhub (R) C554e; Konica Minolta, Inc.) was assembled with no cleaning blade attached. This unit was continuously driven for 1 hour in the HH environment with a belt linear speed controlled to 500 mm/sec. by using an external apparatus for driving an intermediate transfer member.

Next, in the same HH environment, a genuine Y toner for the multifunctional peripheral Bizhub C554e was collected from a genuine Y toner bottle, and was applied onto the whole outer surface of the belt in a concentration of 0.4 g/m$^2$. Thereafter, the intermediate transfer unit was assembled again with a genuine blade for the multifunctional peripheral Bizhub C554e attached and with a contact force set to 24 N/m and an effective contact angle set to 12°, and the whole applied toner was supplied to a blade edge by causing the belt to run around once.

After resetting a torque value immediately before the driving to 0 (zero), the intermediate transfer member was driven for 15 seconds at a running speed of 250 mm/sec., and in a range of 5 to 15 seconds after starting the driving, driving torque data was obtained by converting a current value obtained by a strain measuring apparatus into a torque at an interval of 10 msec., the thus obtained driving torque data was averaged, and the torque was calculated as a difference from the state where the torque was 0 (zero) immediately before the driving.

Incidentally, for comparison, driving torque data (as a reference value) obtained by using a genuine intermediate transfer unit of the commercially available full-color multifunctional peripheral (Bizhub C554e) was obtained similarly by using a genuine blade attached with a contact force set to 24 N/m and an effective contact angle set to 12°.

The dynamic friction force of each evaluation apparatus (each intermediate transfer member) was compared in terms of a ratio to the reference value on the assumption that a ratio of a value obtained by using the genuine intermediate transfer member of the commercially available full-color multifunctional peripheral (Bizhub C554e) was 1, and was evaluated based on the following criteria. It is noted that those evaluated as "A", "B" and "C" were determined as accepted.

A: The ratio of the dynamic friction force was 1.5 or less.

B: The ratio of the dynamic friction force was more than 1.5, and 2.0 or less.

C: The ratio of the dynamic friction force was more than 2.0, and 2.5 or less.

D: The ratio of the dynamic friction force was more than 2.5.

E: The evaluation could not be made because the driving rotation was stopped during the driving for 15 seconds.

Evaluation results of the reaction rate and evaluation results of the dynamic friction force are shown in Table 3 below.

TABLE 3

| | Intermediate Transfer Member No. | Evaluation of Reaction Rate: Reaction Rate (%) | Evaluation of Reaction Rate: Evaluation Result | Evaluation of Dynamic Friction Force: Ratio of Dynamic Friction Force | Evaluation of Dynamic Friction Force: Evaluation Result |
|---|---|---|---|---|---|
| Example | 1 | 92.5 | A | 2.43 | C |
| | 2 | 93.1 | A | 1.92 | B |
| | 3 | 93.6 | A | 1.51 | B |
| | 4 | 94.1 | A | 1.10 | A |
| | 5 | 94.2 | A | 1.09 | A |
| | 6 | 92.7 | A | 2.40 | C |
| | 7 | 93.0 | A | 1.95 | B |
| | 8 | 94.3 | A | 1.51 | B |
| | 9 | 95.2 | A | 1.11 | A |
| Comparative Example | 10 | 86.7 | B | 2.98 | D |
| | 11 | 89.3 | B | 2.91 | D |
| | 12 | 91.1 | A | 2.96 | D |
| | 13 | 82.1 | C | — | E |

As shown in Table 3, intermediate transfer members 1 to 9 each containing the tertiary amine compound having a melting point of 30° C. or more in which at least one hydrogen atom is bonded to one carbon atom out of three carbon atoms bonded to a nitrogen atom were evaluated as good in both the reaction rate and the dynamic friction force. In particular, if the melting point of the tertiary amine compound is 100° C. or more, the effect of reducing the dynamic friction force was particularly good. Besides, in intermediate transfer members 4, 5 and 9 each containing the tertiary amine compound in which at least one aromatic group is bonded to the nitrogen atom, the effect of reducing the dynamic friction force was particularly good as compared with that of an intermediate transfer members containing a tertiary amine compound in which at least one aliphatic group is bonded to a nitrogen atom.

On the other hand, in intermediate transfer members 10 and 11 each containing a compound that has a prescribed aromatic group but is not a prescribed tertiary amine compound, the effect of suppressing the increase in the dynamic friction force was poor. This is probably because the amount of residual oligomer and the like was increased due to a poor effect of increasing the reaction rate, and the effect of suppressing the increase in the dynamic friction force was also poor due to the bleed-out of the oligomer and the like. Besides, in intermediate transfer member 12 containing a tertiary amine compound having a melting point lower than 30° C., the bleed-out of the tertiary amine compound itself was caused when left in the HH environment, and hence although the reaction rate was good, the effect of suppressing the increase in the dynamic friction force was poor. In intermediate transfer member 13 containing no tertiary amine compound, the effect of increasing the reaction rate was so poor that the amount of residual oligomer and the like was increased, and the effect of suppressing the increase in the dynamic friction force was also poor due to the bleed-out of the oligomer and the like. It is noted that intermediate transfer member 13 was not evaluated for the torque because of blade peeling.

Although embodiments of the present invention have been described and illustrated in detail, it is clearly understood that the same is by way of illustration and example only and not limitation, the scope of the present invention should be interpreted by terms of the appended claims.

INDUSTRIAL APPLICABILITY

According to the present invention, increase in dynamic friction force can be suppressed over time in an intermediate transfer member of an electrophotographic image forming apparatus. Therefore, according to the present invention, an electrophotographic image forming apparatus can be expected to be further improved in performance and durability, and to be further widely used.

What is claimed is:

1. An intermediate transfer member, comprising a resin substrate layer and a surface layer disposed on the substrate layer, wherein the surface layer contains a cured product of a resin composition containing a polyfunctional (meth) acrylate, a photopolymerization initiator, and a tertiary amine compound having a melting point of 30° C. or more, and at least one hydrogen atom is bonded to one carbon atom out of three carbon atoms bonded to a nitrogen atom in the tertiary amine compound.

2. The intermediate transfer member according to claim 1, wherein at least one aromatic group is bonded to the nitrogen atom of the tertiary amine compound.

3. The intermediate transfer member according to claim 1, wherein the melting point of the tertiary amine compound is 45° C. or more.

4. The intermediate transfer member according to claim 1, wherein the melting point of the tertiary amine compound is 65° C. or more.

5. The intermediate transfer member according to claim 1, wherein the melting point of the tertiary amine compound is 95° C. or more.

6. The intermediate transfer member according to claim 1, wherein the photopolymerization initiator has a phosphine oxide skeleton or an oxime ester skeleton.

7. The intermediate transfer member according to claim 1, wherein the surface layer contains a metal oxide fine particle that carries, on a surface thereof, a carried substance having a radically polymerizable functional group.

8. The intermediate transfer member according to claim 7, wherein the radically polymerizable functional group is a (meth)acryloyl group.

9. A method for producing an intermediate transfer member including a resin substrate layer and a surface layer disposed on the substrate layer, comprising:

forming, on the substrate layer, a coating film containing a resin composition that contains a polyfunctional (meth)acrylate, a photopolymerization initiator, and a tertiary amine compound having a melting point of 30° C. or more; and forming the surface layer on the substrate layer by causing radical polymerization of the polyfunctional (meth) acrylate contained in the coating film, wherein a tertiary amine compound in which at least one hydrogen atom is bonded to one carbon atom out of three carbon atoms bonded to a nitrogen atom is used as the tertiary amine compound.

10. An electrophotographic image forming apparatus, comprising:

an intermediate transfer member that bears a toner image having been born on a photoconductor to transfer the toner image onto a recording medium; and a cleaner that removes an adhering substance adhering to a surface of the intermediate transfer member, wherein the intermediate transfer member is the intermediate transfer member according to claim 1, and the cleaner includes an elastic member to be brought into contact with the surface of the intermediate transfer member to remove the adhering substance.

* * * * *